US010281250B2

(12) United States Patent
Beck et al.

(10) Patent No.: US 10,281,250 B2
(45) Date of Patent: May 7, 2019

(54) BROADHEAD DEPLOYMENT/LOCKING SYSTEM AND METHOD

(71) Applicant: BARNETT OUTDOORS, LLC, Tarpon Springs, FL (US)

(72) Inventors: Mark Beck, Irvington, KY (US); Dale Perry, Goodyear, AZ (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 15/801,537

(22) Filed: Nov. 2, 2017

(65) Prior Publication Data

US 2018/0128584 A1 May 10, 2018

Related U.S. Application Data

(60) Provisional application No. 62/417,645, filed on Nov. 4, 2016.

(51) Int. Cl.
*F42B 6/08* (2006.01)
*F42B 12/34* (2006.01)

(52) U.S. Cl.
CPC ..... *F42B 6/08* (2013.01); *F42B 12/34* (2013.01)

(58) Field of Classification Search
CPC ..... F42B 6/08
USPC ..... 473/583
See application file for complete search history.

(56) References Cited

U.S. PATENT DOCUMENTS 4,166,619 A * 9/1979 Bergmann ..... F42B 12/362 30/161
4,579,348 A * 4/1986 Jones ..... F42B 6/08 473/583
4,976,443 A * 12/1990 DeLucia ..... F42B 6/08 473/583
5,066,021 A * 11/1991 DeLucia ..... F42B 6/08 473/583
5,564,713 A * 10/1996 Mizek ..... F42B 6/08 473/583
6,258,000 B1 * 7/2001 Liechty, II ..... F42B 6/08 473/583
6,270,435 B1 * 8/2001 Sodaro ..... F42B 6/08 473/583
6,322,464 B1 * 11/2001 Sestak ..... F42B 6/08 473/583
6,830,523 B1 * 12/2004 Kuhn ..... F42B 6/08 473/583
6,935,976 B1 * 8/2005 Grace, Jr. ..... F42B 6/08 473/583
7,713,152 B1 * 5/2010 Tentler ..... F42B 6/08 473/583
7,942,765 B2 * 5/2011 Odabachian ..... F42B 6/08 473/583

(Continued)

*Primary Examiner* — Alexander R Niconovich
(74) *Attorney, Agent, or Firm* — Jones Walker LLP

(57) ABSTRACT

A broadhead containing independent pivotable and retractable cutting blades configured for selective locking in a non-deployed and deployed position. The broadhead further contains a non-rotating blade configured for reciprocating movement in order to selectively lock the pivoting blades in their non-deployed and deployed positions. Impact of the broadhead with a target will cause the pivoting blades to transition from the non-deployed position to the deployed position and thereby create a larger cutting diameter.

28 Claims, 7 Drawing Sheets

(56) References Cited

U.S. PATENT DOCUMENTS

| | | | | |
|---|---|---|---|---|
| 8,043,177 | B2 * | 10/2011 | Flanagan | F42B 6/08 473/583 |
| 8,100,788 | B2 * | 1/2012 | Sanford | F42B 6/08 473/582 |
| 8,182,378 | B1 * | 5/2012 | Futtere | F42B 6/08 473/583 |
| 8,449,415 | B2 * | 5/2013 | Grace | F42B 6/08 473/583 |
| 8,496,550 | B2 * | 7/2013 | Zeren | F42B 6/08 473/583 |
| 8,529,385 | B1 * | 9/2013 | Lee | F42B 6/08 473/583 |
| 8,764,591 | B2 * | 7/2014 | Hand | F42B 6/08 473/578 |
| 8,905,874 | B2 * | 12/2014 | Sullivan | F42B 12/34 473/583 |
| 8,911,310 | B2 * | 12/2014 | Lee | F42B 6/08 473/583 |
| 8,926,457 | B2 * | 1/2015 | Treto | F42B 6/08 473/583 |
| 9,052,170 | B1 * | 6/2015 | Campbell | F42B 12/34 |
| 9,091,515 | B1 * | 7/2015 | Lee | F42B 6/08 |
| 9,194,673 | B1 * | 11/2015 | Lee | F42B 12/34 |
| 9,341,451 | B1 * | 5/2016 | Campbell | F42B 12/34 |
| 9,372,056 | B2 * | 6/2016 | Sullivan | F42B 6/08 |
| 9,526,234 | B2 * | 12/2016 | Harshberger | A01K 81/00 |
| 9,683,819 | B2 * | 6/2017 | Buchanan | F42B 6/08 |
| 9,857,152 | B2 * | 1/2018 | Franco, Sr. | F42B 6/08 |
| 2014/0187364 | A1 * | 7/2014 | Hand | F42B 6/08 473/583 |
| 2017/0191808 | A1 * | 7/2017 | Grace | F42B 6/08 |

* cited by examiner

BROADHEAD DEPLOYMENT/LOCKING SYSTEM AND METHOD

CROSS-REFERENCE TO RELATED APPLICATIONS

This application claims priority to U.S. Provisional Application No. 62/417,645, filed on Nov. 4, 2016, which is incorporated by reference herein in its entirety.

BACKGROUND OF THE DISCLOSURE

The disclosure relates to broadheads for archery and crossbow arrows or bolts, and particularly to broadheads including independent pivotable blades configured for locking in variable positions such as a non-deployed and deployed positions.

SUMMARY OF THE DISCLOSURE

The disclosure describes an embodiment of a broadhead. The embodiment includes a ferrule having an upper section, a lower section, and a blade section interconnecting the upper and lower sections. The ferrule includes a split extending longitudinally through the upper section and into the blade section defining a first side section and a second side section of the blade section. Each of the first and second side sections of the blade section includes a longitudinally extending aperture. The lower section may be configured for detachable connection to an arrow or bolt shaft.

The embodiment may include a first pivoting blade with a blade arm, a deployment arm, and a transition area interconnecting the blade arm and the deployment arm. The transition area includes a pin recess therethrough. The deployment arm includes a front edge having a first locking shoulder spaced apart from a second locking shoulder. The blade arm includes an outside edge configured for cutting.

The embodiment may also include a second pivoting blade with a blade arm, a deployment arm, and a transition area interconnecting the blade arm and the deployment arm. The transition area includes a pin recess therethrough. The deployment arm includes a front edge having a first locking shoulder spaced apart from a second locking shoulder. The blade arm includes an outside edge configured for cutting.

The embodiment may also include a pivot pin.

The embodiment may also include a reciprocating blade having a lower blade section and an upper neck section. The lower blade section includes a first arm section and a second arm section. The first arm section includes an outer edge having a cutting surface, an inner edge, and a bottom edge interconnecting the outer and inner edges. The second arm section includes an outer cutting edge, an inner edge, and a bottom edge interconnecting the outer and inner edges. The inner edges of the first and second arm sections may be interconnected by a transverse edge. The inner edges of the first and second arm sections and the transverse edge define a slot.

The embodiment may also include a spring with an upper section, a lower section, and an inner cavity.

The embodiment may also include a tip having an upper end, a lower end, and an inner cavity defined by an inner surface. The lower end may be configured for detachable connection to the upper section of the ferrule.

In this embodiment, the first and second pivoting blades are pivotally connected to the ferrule and each other in stacked arrangement by alignment of the pin recesses of the first and second pivoting blades within the split of the ferrule and placement of the pivot pin within the aligned pin recesses to form a pivot axis within the split of the ferrule.

In this embodiment, the deployment arm of the first pivoting blade extends from the pivot axis out through the aperture of the second side section of the blade section and the blade arm of the first pivoting blade extends from the pivot axis out through the aperture in the first side section of the blade section.

In this embodiment, the deployment arm of the second pivoting blade extends from the pivot axis out through the aperture of the first side section of the blade section and the blade arm of the second pivoting blade extends from the pivot axis out through the aperture in the second side section of the blade section.

In this embodiment, the lower section of the reciprocating blade is positioned within the split of the ferrule with the inner edges of the first and second arm sections placed over the pivot pin to contain the pivot pin within the aligned recesses of the first and second pivoting blades and the transverse edge of the reciprocating blade being in operative association with the front edges of the deployment arms of the first and second pivoting blades.

In this embodiment, the spring is positioned within the inner cavity of the tip. The upper section of the spring is supported by the inner surface of the tip. The lower section of the spring is supported by the neck section of the reciprocating blade.

In this embodiment, the tip is detachably connected to the upper section of the ferrule.

In this embodiment, selective placement of the transverse edge of the reciprocating blade adjacent the first locking shoulders of the first and second pivoting blades defines a non-deployed position of the first and second pivoting blades and selective placement of the transverse edge of the reciprocating blade adjacent the second locking shoulders of the first and second pivoting blades defines a deployed position of the first and second pivoting blades.

In another embodiment, each of the lower and upper sections of the ferrule contains threads, and the inner surface of the lower section of the tip contains threads.

In another embodiment, the ferrule includes an intermediate section interconnecting the lower section and the blade section.

In another embodiment, the split longitudinally extends substantially through the entirety of the blade section.

In another embodiment, the apertures in the first and second side sections of the blade section each longitudinally extends substantially the entire length of the blade section.

In another embodiment, the ferrule includes an enlarged recess configured to accommodate the pivot pin.

In another embodiment, the upper section of the ferrule includes a shoulder supporting the lower end of the tip.

In another embodiment, the first pivoting blade is pivotably connected to the ferrule below the second pivoting blade.

In another embodiment, the upper neck section of the reciprocating blade includes a tab portion and two opposing shoulders at the base of the tab portion. The tab portion is housed within the inner cavity of the spring. The lower section of the spring is supported by the two opposing shoulders.

In another embodiment, the first and second arm sections of the lower blade section of the reciprocating blade each includes an aperture.

In another embodiment, in the non-deployed position, each of the blade arms of the first and second pivoting blades are positioned at an angle in the range of 10° to 20° relative to a longitudinal axis of the ferrule.

In another embodiment, in the non-deployed position, each of the blade arms of the first and second pivoting blades are positioned at an angle of about 15° relative to the longitudinal axis of the ferrule.

In another embodiment, in the deployed position, each of the blade arms of the first and second pivoting blades are positioned at an angle in the range of 40° to 80° relative to a longitudinal axis of the ferrule.

In another embodiment, in the deployed position, each of the blade arms of the first and second pivoting blades are positioned at an angle of about 60° relative to the longitudinal axis of the ferrule.

In another embodiment, the lower section of the reciprocating blade is triangularly shaped.

In another embodiment, the outer edges of the first and second arm sections of the lower blade section are each positioned at an angle in the range of 15° to 40° relative to a longitudinal axis of the reciprocating blade.

In another embodiment, the outer edges of the first and second arm sections of the lower blade section are each positioned at an angle of about 30° relative to the longitudinal axis of the reciprocating blade.

The disclosure also describes a further embodiment of a broadhead. This embodiment includes a ferrule having an upper section, a lower section, and a blade section interconnecting the upper and lower sections. This embodiment may include a first pivoting blade and a second pivoting blade. Each of the first and second pivoting blades are operatively connected to the ferrule. Each of the first and second pivoting blades have a non-deployed position and a deployed position. Each of the first and second pivoting blades are independently pivotable in relation to the ferrule and each other. This embodiment may also include a non-pivoting blade operatively connected to the ferrule. This embodiment may also include a tip operatively connected to the upper section of the ferrule. In the embodiment, in the non-deployed position, the first and second pivoting blades have a cutting diameter less than a cutting diameter of the non-pivoting blade. In the deployed position, the first and second pivoting blades have a cutting diameter equal to or greater than the cutting diameter of the non-pivoting blade.

In another embodiment, a biasing means is provided. The biasing means provide a biasing force upon the non-pivoting blade to reciprocate the non-pivoting blade against the first and second pivoting blades in a first position to thereby lock the first and second pivoting blades in the non-deployed position.

In another embodiment, each of the first and second pivoting blades includes a locking shoulder for locking the first and second pivoting blades in the deployed position. In the deployed position, the non-pivoting blade is reciprocated by the biasing force against the first and second pivoting blades in a second position. In the second position, the non-pivoting blade is in operative association with the locking shoulder to thereby prevent the first and second pivoting blades from retracting to the non-deployed position.

In another embodiment, each of the first and second pivoting blades includes another locking shoulder. When the non-pivoting blade is in the first position, the non-pivoting blade is in operative association with the another locking shoulder to thereby maintaining the first and second pivoting blades in the non-deployed position.

In another embodiment, the cutting diameter of the non-pivoting blade is about 1 inch.

In another embodiment, in the deployed position, the cutting diameter of the first and second pivoting blades is about 2 inches.

The disclosure also concerns a method of using a broadhead. The method includes the step of providing an embodiment of the broadhead as described hereinabove. The method further includes the step of affixing the broadhead to an arrow or bolt, with the first and second pivoting blades being in the non-deployed position. The method also includes the step of firing the arrow or bolt from an archery bow or crossbow at a target. The first and second pivoting blades are locked in the non-deployed position during flight of the arrow or bolt. The method also includes the step of causing the broadhead to impact the target. The first and second pivoting blades are placed in the deployed position upon impact of the broadhead with the target and are locked in the deployed position.

In an embodiment of the method, the first and second pivoting blades are locked in the non-deployed position by a biasing force placed upon the front edges of the deployment arms by the transverse edge of the reciprocating blade positioned adjacent to the first locking shoulders.

In another embodiment of the method, the biasing force is transferred to the transverse edge of the reciprocating blade by the spring.

In another embodiment of the method, the first and second pivoting blades transition from the locked non-deployed position to the locked deployed position by the impact of the broadhead with the target which causes an impact force to be applied to the deployment arms sufficient to overcome the biasing force resulting in first and second pivoting blades outwardly pivoting from the ferrule such that the transverse edge is repositioned from a first position adjacent to the first locking shoulder to a second position adjacent to the second locking shoulder of the front edges of the deployment arms, whereby the second locking shoulder prevents the first and second pivoting blades from retracting to the non-deployed position.

In another embodiment of the method, the method includes the step of causing the first and second pivoting blades to return from the locked deployed position to the locked non-deployed position by a user pressing upward on one or more of the bottom edges of the first and second arm sections of the lower section of the reciprocating blade to release the transverse edge from applying biasing force to the front edges of the deployment arms.

DETAILED DESCRIPTION OF THE DISCLOSURE

Figure 1:
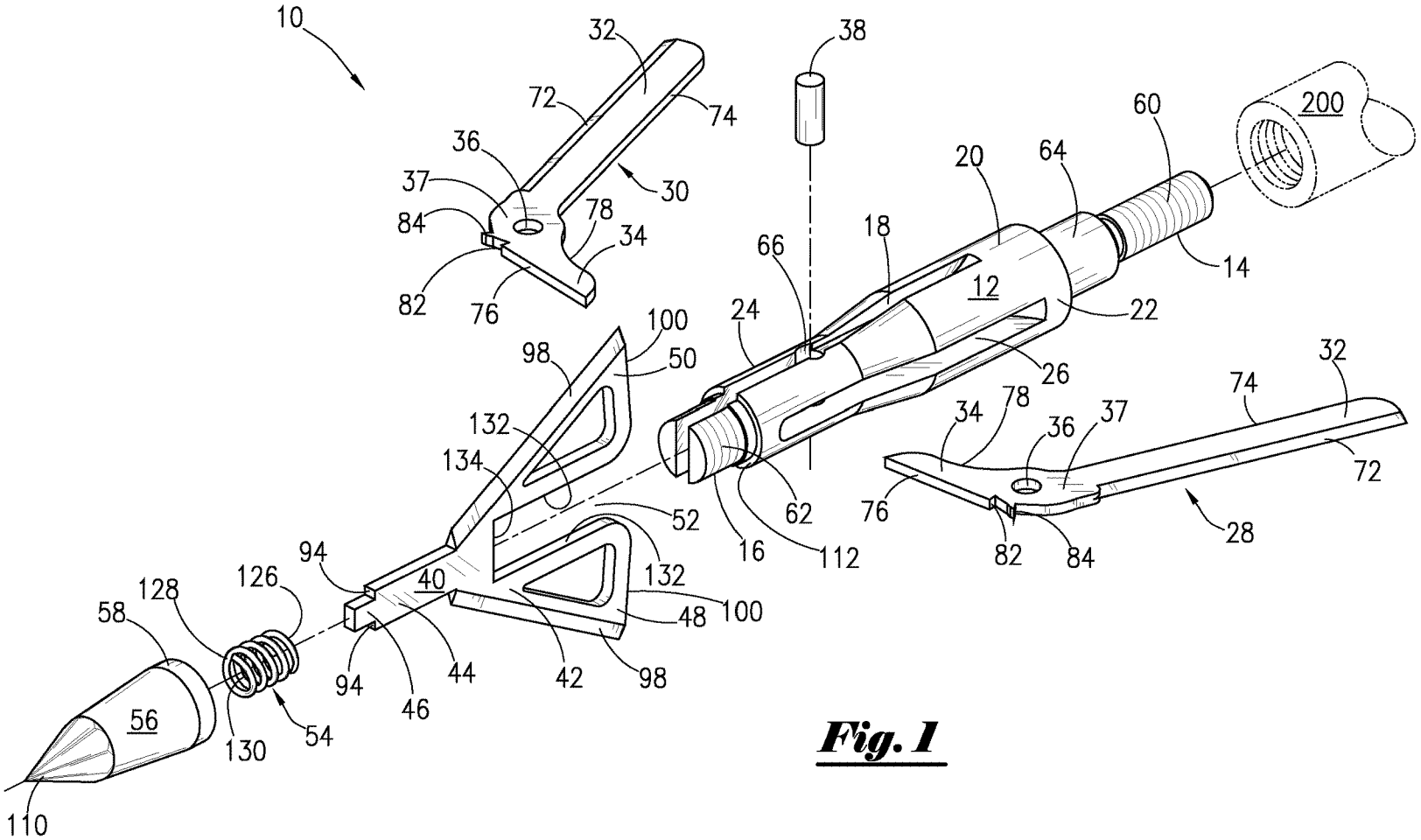
FIG. 1 is an exploded view of an embodiment of the broadhead.

With reference to the figures where like elements have been given like numerical designation to facilitate an understanding of the disclosure, and in particular with reference to the embodiment of broadhead 10 illustrated in FIG. 1, broadhead 10 may be constructed of ferrule 12, first and second pivoting blades 28, 30, pivot pin 38, reciprocating blade 40, spring 54, and tip 56. Ferrule 12 may include lower section 14 and upper section 16. Ferrule 12 may also include intermediate section 64 and blade section 20. Intermediate section 64 interconnects lower section 14 and blade section 20. Lower section 14 may be configured for detachable connection to the front end of arrow or bolt shaft 200. For example, lower section 14 may contain threads 60 that threadedly connect to mating threads (not shown) at the front end of the arrow or bolt shaft 200 or to an outsert/insert (not shown) positioned within the front end of the arrow or bolt shaft 200 as would be understood by one of ordinary skill in the art.

With reference to FIG. 1, ferrule 12 may contain split 18 longitudinally extending within blade section 20. Split 18 may extend from upper section 16 entirely or partially through blade section 20. As seen in FIG. 1, split 18 extends substantially or partially through blade section 20. Split 18 divides blade section 20 into first side section 22 and second side section 24. Each of the first and second side sections 22, 24 may include a longitudinally extending aperture 26. The length of apertures 26 may be dimensioned so as to receive all or portion of respective first or second pivoting blades 28, 30 in their non-deployed position. The height of apertures 26 may be dimensioned to accommodate first and second pivoting blades 28, 30 in stacked arrangement.

Again with reference to FIG. 1, first and second pivoting blades 28, 30 may each include blade arm 32 and deployment arm 34. Pin recess 36 may be positioned in transition area 37 between blade arm 32 and deployment arm 34. First pivoting blade 28 may be configured for partial placement within aperture 26 of side section 22. Second pivoting blade 30 may be configured for partial placement within aperture 26 of side section 24. Pin recesses 36 of the first and second pivoting blades 28, 30 may be aligned (e.g., with second pivoting blade stacked upon first pivoting blade 28) within ferrule 12. First and second pivoting blades 28, 30 may be pivotably connected together by placement of pivot pin 38 into enlarged recess 66 of ferrule 12 and through and within aligned pin recesses 36. In this configuration, each of first and second pivoting blades 28, 30 may be independently pivotable in relation to ferrule 12 and each other.

FIG. 1 also reveals that blade arms 32 may each contain cutting edge 72. Cutting edges 72 may each contain a sharpened cutting surface that will, for example, create a wound channel within an animal when broadhead 10 makes impact with and enters the body of the animal. Cutting edges 72 may extend along a portion of blade arm 32 or the entirety of blade arm 32. Blade arms 32 may each also contain edge 74. Edge 74 may or may not be configured as a cutting surface. In one embodiment, edge 74 is configured as a dull or non-cutting surface.

Also as seen in FIG. 1, each of deployment arms 34 may include (front) edge 76 that may or may not be a cutting surface. Each of deployment arms 34 also may include edge 78 that may or may not be a cutting surface. In one embodiment, edges 76 and 78 are not a cutting surface. For example, edges 76 may each be configured with a dull or non-cutting surface designed to provide sufficient contact area when broadhead 10 (affixed to arrow or bolt shaft 200), after being fired, impacts an animal and begins to enter the body of the animal. Contact of edges 76 with the animal upon impact of broadhead 10 will cause deployment of blade arms 32. Each of edges 76 also may contain first locking shoulder 82 and second locking shoulder 84. First locking shoulders 82 hold, lock or maintain respective first and second pivoting blades 28, 30 in their non-deployed positions. Second locking shoulders 84 hold, lock or maintain respective first and second pivoting blades 28, 30 in their deployed positions. In one embodiment, only the second locking shoulder is provided. The mechanisms for locking first and second pivoting blades 28, 30 in either their non-deployed or deployed positions will be explained hereinbelow.

With further reference to FIG. 1, reciprocating blade 40 may include lower blade section 42 and upper elongated neck section 44. Neck section 44 may include tab portion 46. At the base of tab portion 46, neck section 44 includes two support shoulders 94. Lower blade section 42 may include first arm section 48 and second arm section 50 spaced apart by slot 52. Slot 52 may be defined by opposing side edges 132 of respective first and second arm sections 48, 50 interconnected by transverse edge 134. Reciprocating blade 40 may be configured to be inserted into split 18 with first and second arm sections 48, 50 positioned around pivot pin 38 and transition areas 37 of first and second pivoting blades 28, 30 where pivot pin 38 is inserted into pin recesses 36 of blades 28, 30. Thus, first and second arm sections 48, 50 contain—within slot 52—pivot pin 38 positioned within aligned pin recesses 36 of first and second pivoting blades 28, 30. When reciprocating blade 40 is in operational position within split 18 of ferrule 12, pivot pin 38 and the pivoting point or axis of first and second pivoting blades 28, 30 are positioned within slot 52 of reciprocating blade 40 and between first and second arm sections 48, 50, which contain first and second pivoting blades 28, 30 in operative pivoting position within ferrule 12.

FIG. 1 also shows that spring 54 may include lower end 126 and upper end 128. Spring 54 may also include internal cavity 130. When broadhead 10 is assembled, lower end 126 of spring 54 abuts supporting shoulders 94 of neck section 44. Upper end 128 of spring 54 abuts upper surface 124 (not shown) of tip 56. Internal cavity 130 of spring 54 receives tab portion 46 of reciprocating blade 40. Spring 54 may bias reciprocating blade 40. For example, expansion of spring 54 biases reciprocating blade 40 in a downward direction relative to ferrule 12. Conversely, movement of reciprocating blade 40 in an upward direction relative to tip 56 causes compression of spring 54.

FIG. 1 further depicts that tip 56 may include point 110. Point 110 may be tapered and in a chiseled pattern. Point 110 is configured for penetration of an animal. Tip 56 may also include lower end 58 that detachably connects to upper section 16 of ferrule 12. For example, tip 56 may contain internal threads that mate with threads 62 on upper section 16 of ferrule 12. Thus, tip 56 may be connected to ferrule 12 by threaded connection. When tip 56 is fully threaded to threads 62 of upper section 16, lower end 58 abuts and is supported by shoulder 112 of ferrule 12.

FIGS. 2-7 show broadhead 10 with first and second pivoting blades 28, 30 in their non-deployed position. The non-deployed position is used when firing arrow or bolt shaft 200 to which broadhead 10 is affixed. During firing and flight of broadhead 10, first and second pivoting blades 28, 30 maintain their non-deployed position due to the application of a downward biasing force produced by spring 54 that is transferred to reciprocating blade 40 and from reciprocating blade 40 to first and second pivoting blades 28, 30 as will be explained herein. In the non-deployed position, first and second pivoting blades 28, 30 are retracted. For example, blade arms 32 of first and second pivoting blades 28, 30 may each be entirely, substantially, or partially contained within respective apertures 26 of blade section 20. As a further example, blade arms 32 may each be positioned substantially parallel with and adjacent to blade section 20 and deployment arms 34 may be substantially perpendicular to blade section 20. Alternatively, the outer diameter of the profile of first and second pivoting blades 28, 30 in the non-deployed position (e.g., the cutting diameter) may be equal to or less than the cutting diameter of reciprocating blade 40. For example, the cutting diameter of first and second pivoting blades 28, 30 may be less than 1 inch. Alternatively, blade arms 32 may each be set at an angle in the range of 10° and 20° relative a longitudinal axis running through ferrule 12 from upper section 16 to lower section 14. Alternatively, blade arms 32 may each be set at an angle of about 15° relative a longitudinal axis running through ferrule 12 from upper section 16 to lower section 14.

Figure 3:
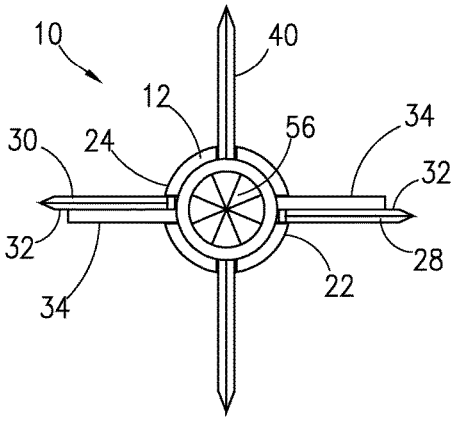
FIG. 3 is a top view of the embodiment of the broadhead shown in FIG. 2.
Figures 5, 6, 7:
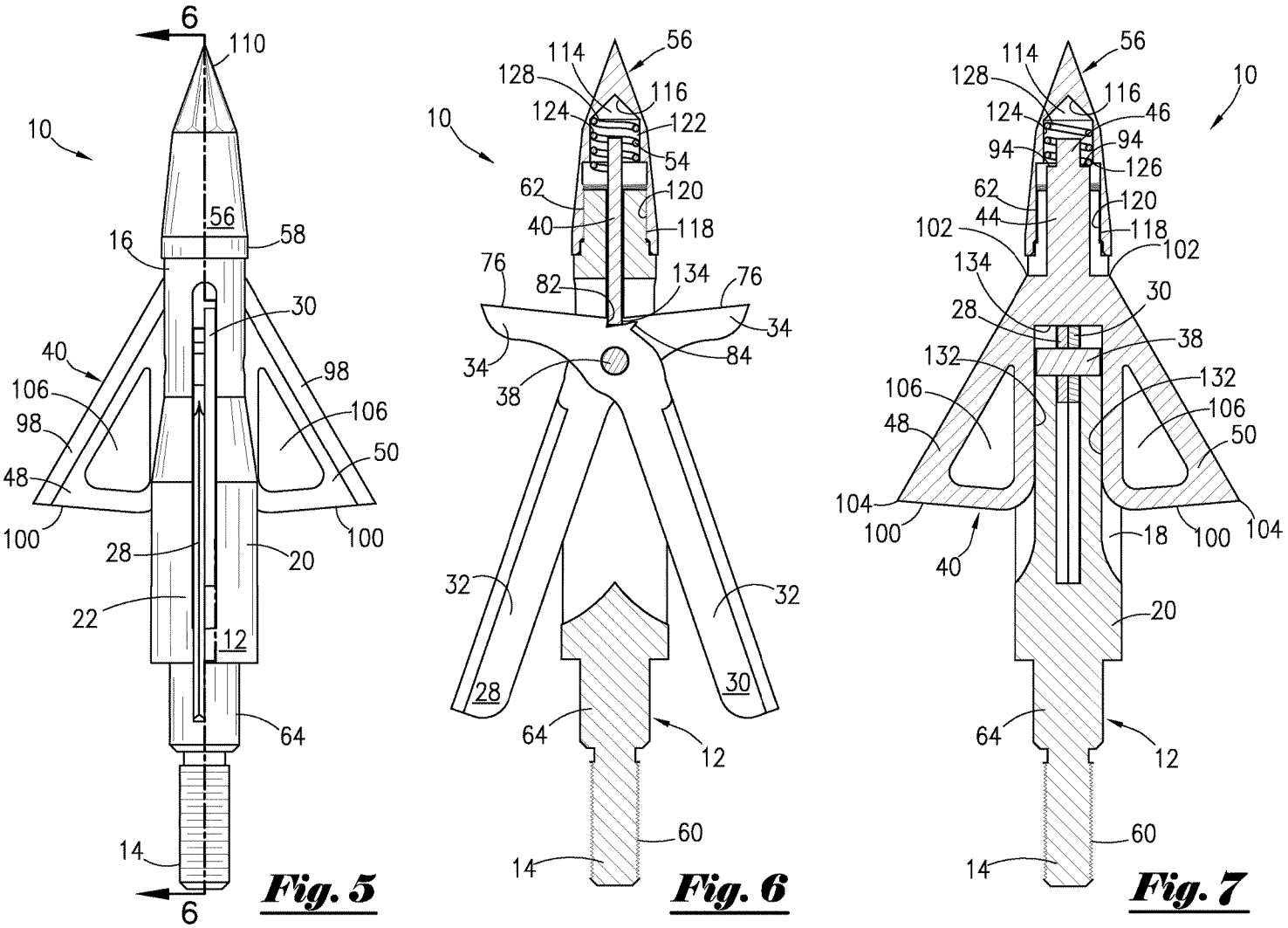
FIG. 5 is a side view of the embodiment of the broadhead shown in FIG. 2.
FIG. 6 is a cross-sectional view of the embodiment of the broadhead shown in FIG. 5 taken along lines 6-6 thereof.
FIG. 7 is a cross-sectional view of the embodiment of the broadhead shown in FIG. 4 taken along lines 7-7 thereof.

FIGS. 3, 5 and 6 show the stacked arrangement of first and second pivoting blades 28, 30. First pivoting blade 28 is positioned beneath second pivoting blade 30. Deployment arm 34 of first pivoting blade 28 extends outwardly from second side section 24 of ferrule 12 while blade arm 32 extends outwardly from first side section 22. Similarly, deployment arm 34 of second pivoting blade 30 extends outwardly from first side section 22 of ferrule 12 while blade arm 32 extends outwardly from second side section 24.

Figure 4:
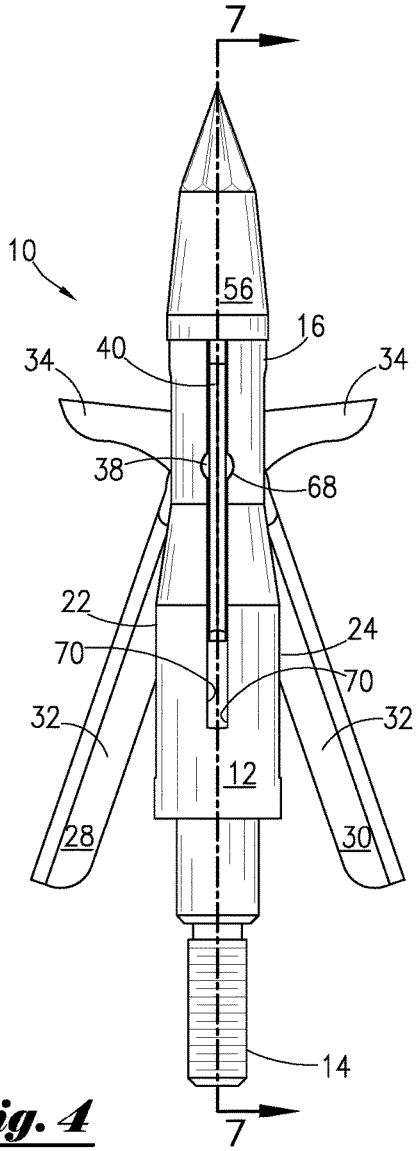
FIG. 4 is a front view of the embodiment of the broadhead shown in FIG. 2.

FIG. 4 reveals inner walls 70 of each of first and second side sections may contain indent 68. Indents 68 may each be C-shaped so as to accommodate the placement of pivot pin 38 therein. Indents 68 form enlarged recess 66 in slit 18 through which pivot pin 38 is inserted and placed within aligned pivot recesses 36 of first and second pivoting blades 28, 30.

As seen in FIGS. 6 and 7, tip 56 may further include inner cavity 114 defined by inner surface 116. Inner cavity 114 may include separate compartments. For example, inner cavity 114 may include lower section compartment 118 and upper section compartment 122. Lower section compartment 118 may have an internal diameter greater than the internal diameter of upper section compartment 122. Upper section compartment 122, defined by inner surface 116, may be dimensioned to receive and accommodate the outer diameter of spring 54. Surface 124 of upper section compartment 122 supports upper end 128 of spring 54. Inner surface 116 of lower compartment 118 (or a portion thereof) may include threads 120 that mate with corresponding threads 62 on upper section 16 of ferrule 12 when tip 56 is threadedly connected to ferrule 12.

FIGS. 5, 6, and 7 shows first and second pivoting blades 28, 30 held or locked into their non-deployed position wherein first and second pivoting blades 28, 30 are situated substantially within or in close proximity to respective apertures 26. This represents the firing and flight placements of first and second pivoting blades 28, 30. Surface 124 of upper section compartment 122 acts as a stop for upper end 128 of spring 54. Spring 54 stores compression/expansion force. The force in spring 54 forces reciprocating blade 40 in a downward direction relative to lower section 14 of ferrule 12. Transverse edge 134 of reciprocating blade 40 pushes down on edges 76 of first and second pivoting blades 28, 30 thereby locking, holding or maintaining first and second pivoting blades 28, 30 in their non-deployed position. Transverse edge 134 sets against first locking shoulder 82 preventing further retraction of blade arms 32 towards blade section 20 of ferrule 12 thus establishing a set or predetermined non-deployed position for first and second pivoting blades 28, 30. First and second pivoting blades 28, 30 will maintain this non-deployed position during firing and flight of an arrow or bolt shaft 200 to which broadhead 10 is affixed. In this non-deployed firing and flight position, broadhead 10 provides a streamlined design optimal for firing from an archery bow or crossbow and optimal for sustaining a straight and extended flight pattern upon firing.

FIG. 7 shows that tab portion 46 is configured and dimensioned to receive and accommodate spring 54. Tab portion 46 may include an outer diameter less than the outer diameter of neck section 44. The outer diameter of tab portion 46 is sized so as to be insertable into the interior cavity 130 of spring 54. Tab portion 46 terminates at shoulders 94 of neck section 44. Shoulders 94 support lower end 126 of spring 54 and act to transfer force in spring 54 to reciprocating blade 40 in order to reciprocate reciprocating blade 40 in a downward direction relative to lower section 14 of ferrule 12. Each of first and second arm sections 48, 50 of lower blade section 42 may include first edge 98. Each of first edges 98 may contain a sharpened cutting surface that will create a wound channel within an animal when broadhead 10 makes impact with the animal. Each of first edges 98 may extend along a portion of respective first and second arm sections 48, 50 or may extend along the entirety of respective first and second arm sections 48, 50. Each of first and second section arms 48, 50 may include bottom edge 100. Each of bottom edges 100 is configured as a dull or non-cutting surface. In one embodiment that will be described herein, bottom edges 100 are configured to be manipulated by a person using the broadhead to apply force in an upward direction relative to tip 56 to reciprocate reciprocating blade 40.

With further reference to FIG. 7, lower blade section 42 may be dimensioned in a triangular shape with first edges 98 extending from distal point 102 to proximal point 104 at an angle in the range of 15° to 40° or at an angle of about 30° in relation to a longitudinal axis running through reciprocating blade 40. At its greatest outer diameter, reciprocating blade 40 has a cutting diameter of about 1 inch. First and second arm sections 48, 50 may be solid or contain apertures 106. Apertures 106 lessen the overall weight of reciprocating blade 40 by removing material. Slot 52 is dimensioned to accommodate the width of first and second pivoting blades 28, 30 in stacked arrangement and contain pivot pin 38 in place within the aligned recesses 36 of the first and second pivoting blades.

FIGS. 8-13 depict broadhead 10 in the deployed position after making impact with an animal or other object. Upon impact, first and second pivoting blades 28, 30 are actuated from the non-deployed position shown in FIG. 2 to their deployed position shown in FIG. 8. In the deployed position, blade arms 32 have moved substantially out and away from respective apertures 26 and blade section 20 of ferrule 12. In their deployed position, first and second pivoting blades 28, 30 may be positioned at an angle in the range of between 40° to 80° in relation to a longitudinal axis running through ferrule 12 and may be positioned at an angle of about 60° in relation to the longitudinal axis running through ferrule 12. In the deployed position, deployment arm 34 of first pivoting blade 28 will have moved from its original substantially perpendicular position relative to blade section 20 of ferrule 12 to an angled position that aligns with the positional angle of blade arm 32 of second pivoting blade 30 (deployment arm 34 being situated below and adjacent to blade arm 32 of second pivoting blade 30). Likewise, deployment arm 34 of second pivoting blade 30 will have moved from its original substantially perpendicular position relative to blade section 20 of ferrule 12 to an angled position that aligns with the positional angle of blade arm 32 of first pivoting blade 28 (deployment arm 34 being situated below and adjacent to blade arm 32 of first pivoting blade 28). In their deployed position, first and second pivoting blades 28, 30 may have a cutting diameter in the range of 1.5 inches to 3 inches, or a cutting diameter of about 2 inches. Reciprocating blade 40 may have a cutting diameter of 0.5 inches to 1.5 inches or a cutting diameter of about 1 inch.

Figure 12:
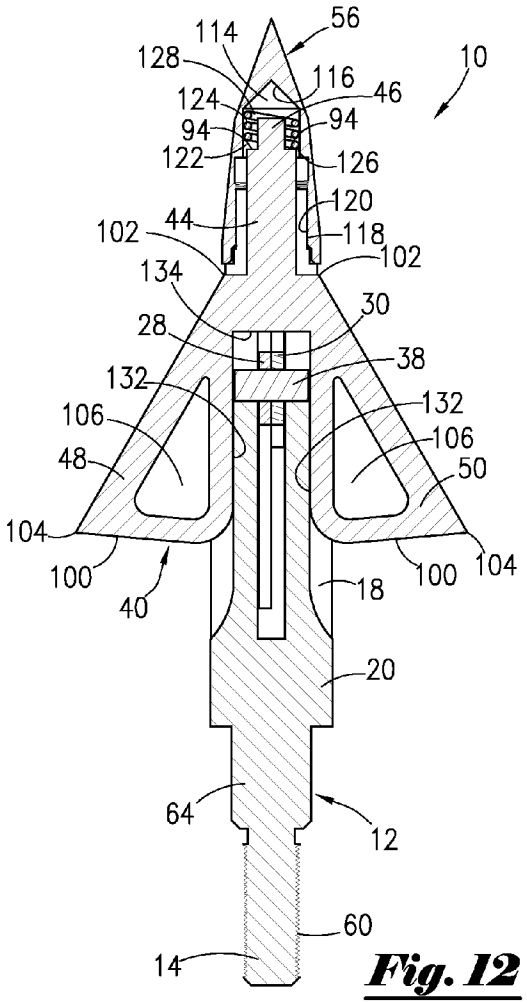
FIG. 12 is a cross-sectional view of the embodiment of the broadhead shown in FIG. 10 taken along lines 12-12 thereof.
Figure 11:
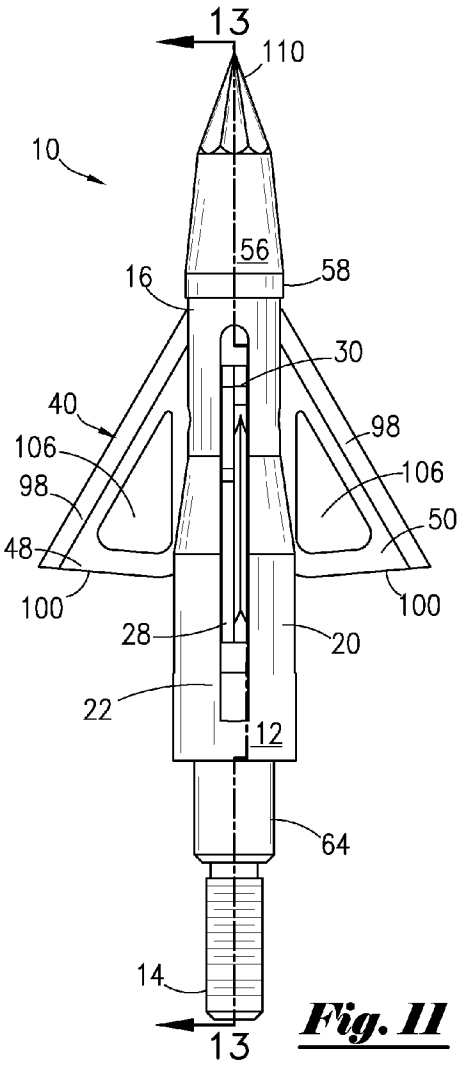
FIG. 11 is a side view of the embodiment of the broadhead shown in FIG. 8.
Figure 13:
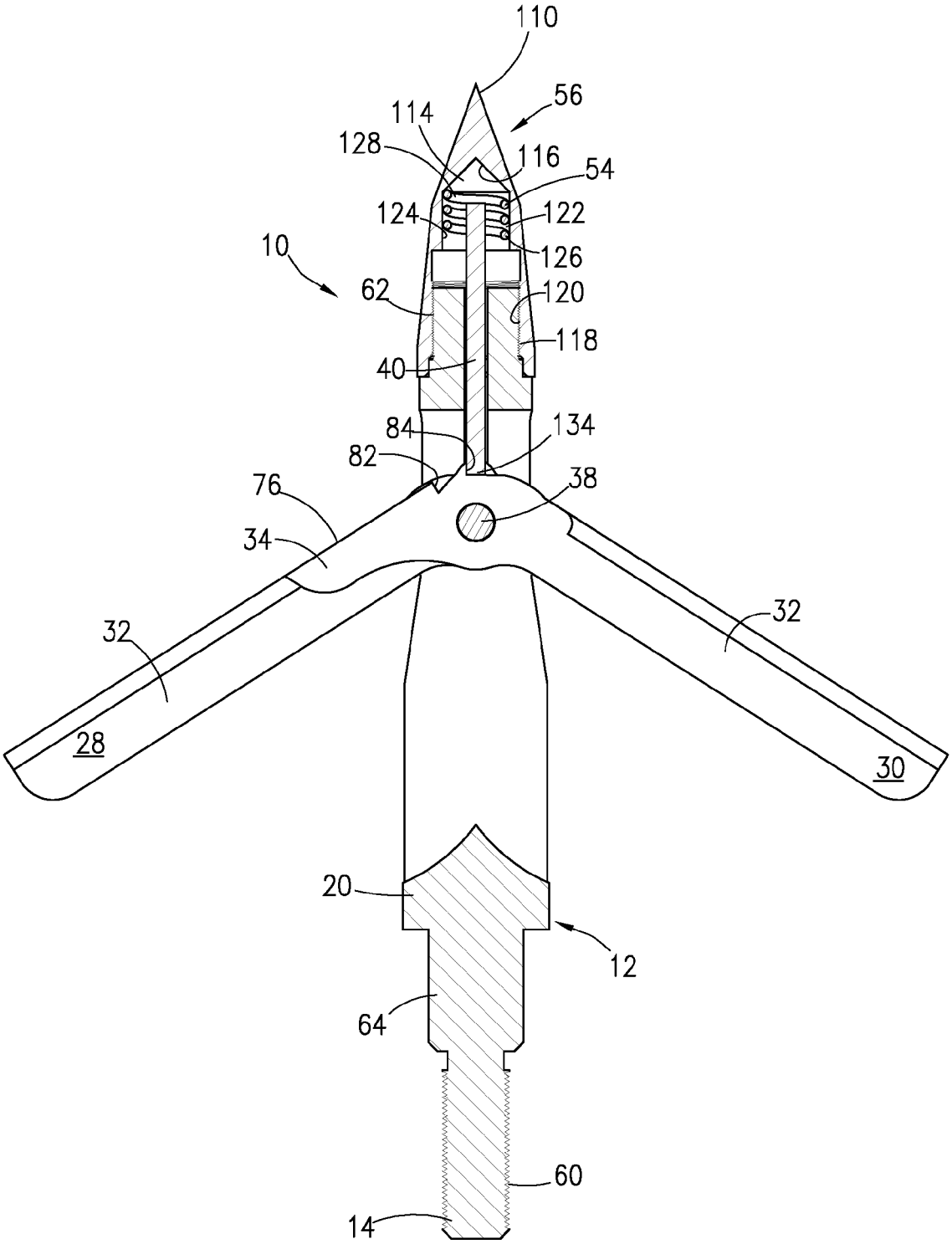
FIG. 13 is a cross-sectional view of the embodiment of the broadhead shown in FIG. 11 taken along line 13-13 thereof.

FIGS. 12 and 13 show first and second pivoting blades 28, 30 held or locked into their deployed position wherein first and second pivoting blades 28, 30 are fully extended outwardly from respective first and second side sections 22, 24 of blade section 20 of ferrule 12. To achieve their deployed position, a sufficient force must be applied to first and second pivoting blades 28, 30 to overcome the biasing force applied to them by transverse edge 134 of reciprocating blade 40 vis-à-vis spring 54 so that edges 76 of deployment arms 34 are able to move in a direction causing first locking shoulder 82 to move away from transverse edge 134 and causing second locking shoulder 84 to move towards and past transverse edge 134. When second locking shoulders 84 moves past transverse edge 134, the biasing force caused by spring 54 forces reciprocating blade 40 in a downward direction relative to lower section 14 of ferrule 12 such that transverse edge 134 is forced against edges 76 and sets adjacent to second locking shoulder 84. Second locking shoulders 84 hold or lock first and second pivoting blades 28, 30 in their deployed position and prevent first and second pivoting blades 28, 30 from retracting into their non-deployed position.

Figure 2:
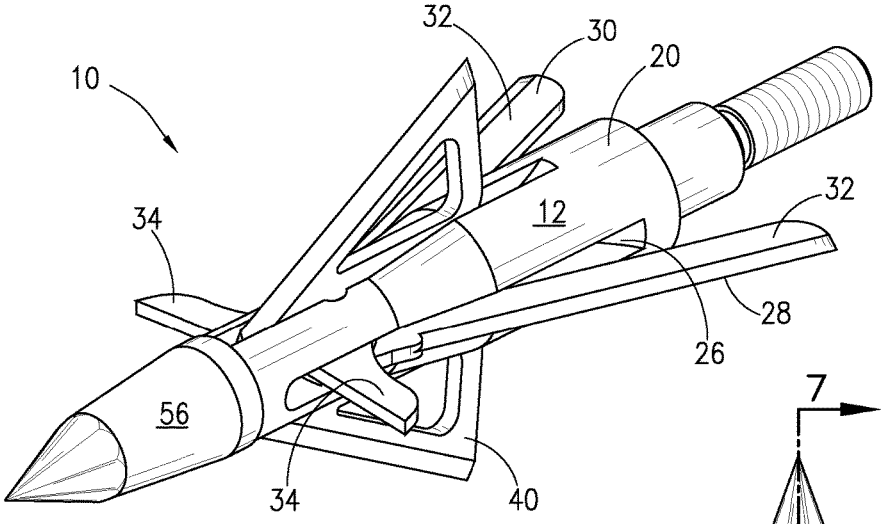
FIG. 2 is a perspective view of an embodiment of the broadhead with the pivoting blades in their non-deployed position.
Figure 8:
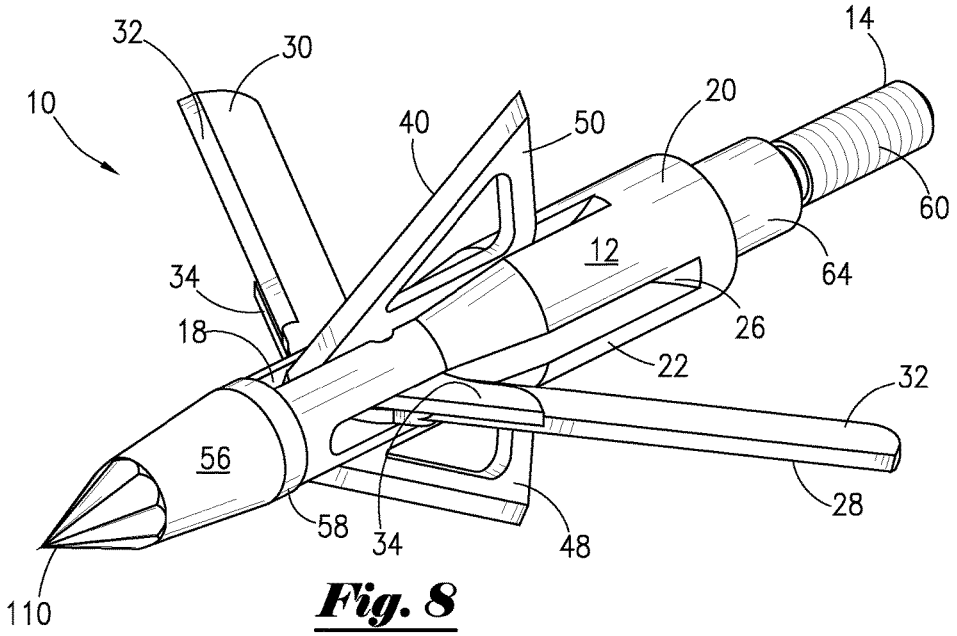
FIG. 8 is a perspective view of an embodiment of the broadhead with the pivoting blades in their deployed position.
Figure 9:
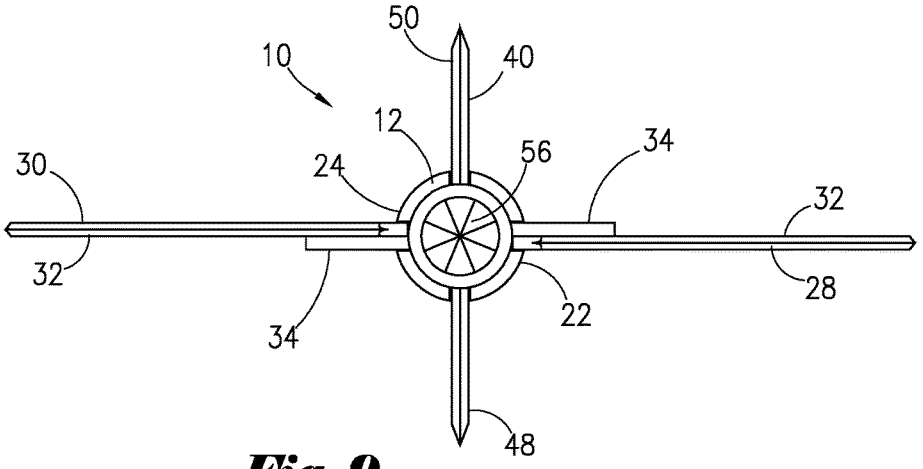
FIG. 9 is a front view of the embodiment of the broadhead shown in FIG. 8.
Figure 10:
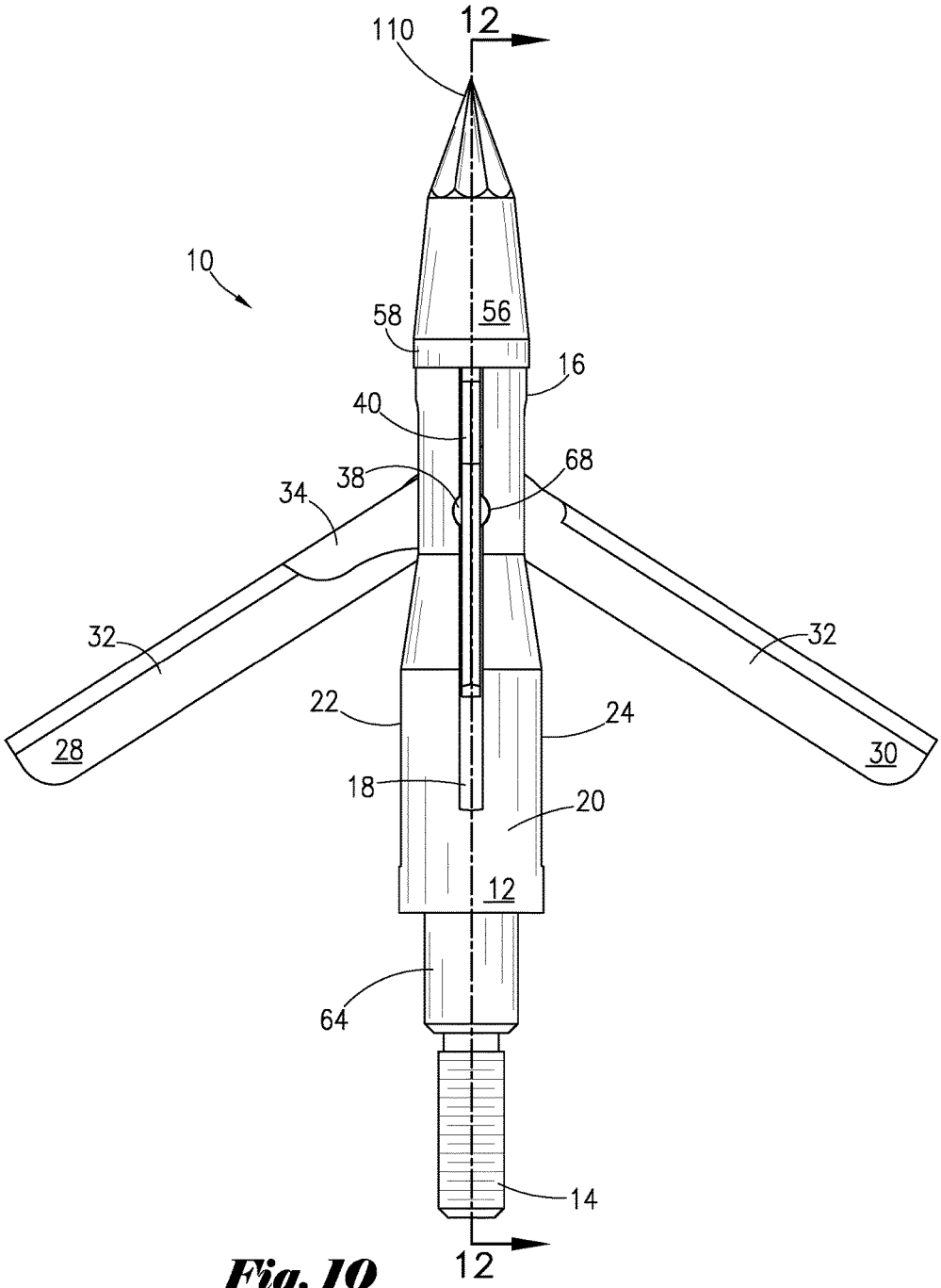
FIG. 10 is a top view of the embodiment of the broadhead shown in FIG. 8.

Broadhead 10 is designed so that upon impact with an animal or other object, the contact force resulting from such impact is sufficient to cause first and second pivoting blades 28, 32 to deploy from their firing, flight, and non-deployed position shown in FIG. 2 to their deployed position as shown in FIG. 8. In other words, the contact force created by the impact of broadhead 10 with the animal will result in sufficient force being applied to first and second pivoting blades 28, 30 to overcome the biasing force being applied by transverse edge 134 of reciprocating blade 40 vis-à-vis spring 54 so that the outward rotation or pivoting of first and second pivoting blades 28, 30 due to the impact overcomes the biasing force of transverse edge 134 placed upon edges 76. As edges 76 of deployment arms 34 contact the animal, first and second pivoting blades 28, 30 are pushed outwardly and into their deployed position. The outward rotation or pivoting of first and second pivoting blades 28, 30 results in transverse edge 134 being placed in position next to second locking shoulder 84, which prevents first and second pivoting blades 28, 30 from retracting to their non-deployed position.

Therefore, upon impact of broadhead 10 with an animal, first and second pivoting blades 28, 30 are pivoted from their non-deployed position to their deployed position resulting in a second and larger cutting configuration. Due to the locking mechanism of the second locking shoulder 84 resting against transverse edge 134 of reciprocating blade 40, first and second pivoting blades 28, 30 are maintained in their deployed position while broadhead 10 enters the animal or object and thereby creates a maximum wound area or pattern within the animal or object. As stated previously, in one embodiment, the maximum diameter of the first and second pivoting blades in their deployed position is about 2 inches.

In order to reset first and second pivoting blades 28, 30 from their deployed position to their non-deployed position, a user may apply an upward force in the direction of tip 56 to one or both of bottom edges 100 of lower blade section 42 of reciprocating blade 40 thereby pushing transverse edge 134 of reciprocating blade 40 upward and away from both first and second locking shoulders 82, 84 thereby releasing any contact of transverse edge 134 with first and second pivoting blades 28, 30. First and second pivoting blades 28, 30 will retract to their non-deployed positions by gravitational force if broadhead 10 is held in an upright position or a user may push first and second pivoting blades 28, 30 back into the non-deployed position.

Ferrule 12 may be composed of any durable material. For example, ferrule 12 may be made of a metal, such as aluminum. Reciprocating blade 40 and first and second pivoting blades 28, 30 may be made from any durable material. For example, reciprocating blade 40 and first and second pivoting blades 28, 30 may be made of metal, such as stainless steel. Tip 56 may likewise be made of any durable material. For example, tip 56 may be made of metal and chiseled.

While various embodiments of the disclosure have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A broadhead comprising:

a ferrule having an upper section, a lower section, and a blade section interconnecting the upper and lower sections, the ferrule including a split extending longitudinally through the upper section and into the blade section defining a first side section and a second side section of the blade section, each of the first and second side sections of the blade section including a longitudinally extending aperture, the lower section configured for detachable connection to an arrow or bolt shaft;

a first pivoting blade including a blade arm, a deployment arm, and a transition area interconnecting the blade arm and the deployment arm, the transition area including a pin recess therethrough, the deployment arm including a front edge having a first locking shoulder spaced apart from a second locking shoulder, the blade arm including an outside edge configured for cutting;

a second pivoting blade including a blade arm, a deployment arm, and a transition area interconnecting the blade arm and the deployment arm, the transition area including a pin recess therethrough, the deployment arm including a front edge having a first locking shoulder spaced apart from a second locking shoulder, the blade arm including an outside edge configured for cutting;

a pivot pin;

a reciprocating blade including a lower blade section and an upper neck section, the lower blade section including a first arm section and a second arm section, the first arm section including an outer edge having a cutting surface, an inner edge, and a bottom edge interconnecting the outer and inner edges, the second arm section including an outer cutting edge, an inner edge, and a bottom edge interconnecting the outer and inner edges, the inner edges of the first and second arm sections interconnected by a transverse edge, the inner edges of the first and second arm sections and the transverse edge defining a slot;

a spring including an upper section, a lower section, and an inner cavity;

a tip including an upper end, a lower end, and an inner cavity defined by an inner surface, the lower end configured for detachable connection to the upper section of the ferrule;

wherein the first and second pivoting blades are pivotally connected to the ferrule and each other in stacked arrangement by alignment of the pin recesses of the first and second pivoting blades within the split of the ferrule and placement of the pivot pin within the aligned pin recesses to form a pivot axis within the split of the ferrule;

wherein the deployment arm of the first pivoting blade extends from the pivot axis out through the aperture of the second side section of the blade section and the blade arm of the first pivoting blade extends from the pivot axis out through the aperture in the first side section of the blade section;

wherein the deployment arm of the second pivoting blade extends from the pivot axis out through the aperture of the first side section of the blade section and the blade arm of the second pivoting blade extends from the pivot axis out through the aperture in the second side section of the blade section;

wherein the lower section of the reciprocating blade is positioned within the split of the ferrule with the inner edges of the first and second arm sections placed over the pivot pin to contain the pivot pin within the aligned recesses of the first and second pivoting blades and the transverse edge of the reciprocating blade being in operative association with the front edges of the deployment arms of the first and second pivoting blades;

wherein the spring is positioned within the inner cavity of the tip, the upper section of the spring supported by the inner surface of the tip, the lower section of the spring supported by the neck section of the reciprocating blade;

wherein the tip is detachably connected to the upper section of the ferrule; and wherein selective placement of the transverse edge of the reciprocating blade adjacent the first locking shoulders of the first and second pivoting blades defines a non-deployed position of the first and second pivoting blades and selective placement of the transverse edge of the reciprocating blade adjacent the second locking shoulders of the first and second pivoting blades defines a deployed position of the first and second pivoting blades.

2. The broadhead of claim 1, wherein each of the lower and upper sections of the ferrule contains threads, and the inner surface of the lower section of the tip contains threads.

3. The broadhead of claim 1, wherein the ferrule includes an intermediate section interconnecting the lower section and the blade section.

4. The broadhead of claim 1, wherein the split longitudinally extends substantially through the entirety of the blade section.

5. The broadhead of claim 4, wherein the apertures in the first and second side sections of the blade section each longitudinally extends substantially the entire length of the blade section.

6. The broadhead of claim 1, wherein the ferrule includes an enlarged recess configured to accommodate the pivot pin.

7. The broadhead of claim 1, wherein the upper section of the ferrule includes a shoulder supporting the lower end of the tip.

8. The broadhead of claim 1, wherein the first pivoting blade is pivotably connected to the ferrule below the second pivoting blade.

9. The broadhead of claim 1, wherein the upper neck section of the reciprocating blade includes a tab portion and two opposing shoulders at the base of the tab portion, wherein the tab portion is housed within the inner cavity of the spring, and wherein the lower section of the spring is supported by the two opposing shoulders.

10. The broadhead of claim 1, wherein the first and second arm sections of the lower blade section of the reciprocating blade each includes an aperture.

11. The broadhead of claim 1, wherein in the non-deployed position, each of the blade arms of the first and second pivoting blades are positioned at an angle in the range of 10° to 20° relative to a longitudinal axis of the ferrule.

12. The broadhead of claim 11, wherein in the non-deployed position, each of the blade arms of the first and second pivoting blades are positioned at an angle of about 15° relative to the longitudinal axis of the ferrule.

13. The broadhead of claim 1, wherein in the deployed position, each of the blade arms of the first and second pivoting blades are positioned at an angle in the range of 40° to 80° relative to a longitudinal axis of the ferrule.

14. The broadhead of claim 13, wherein in the deployed position, each of the blade arms of the first and second pivoting blades are positioned at an angle of about 60° relative to the longitudinal axis of the ferrule.

15. The broadhead of claim 1, wherein the lower section of the reciprocating blade is triangularly shaped.

16. The broadhead of claim 15, wherein the outer edges of the first and second arm sections of the lower blade section are each positioned at an angle in the range of 15° to 40° relative to a longitudinal axis of the reciprocating blade.

17. The broadhead of claim 16, wherein the outer edges of the first and second arm sections of the lower blade section are each positioned at an angle of about 30° relative to the longitudinal axis of the reciprocating blade.

18. A broadhead comprising:

a ferrule having an upper section, a lower section, and a blade section interconnecting the upper and lower sections;

a first pivoting blade and a second pivoting blade, each of the first and second pivoting blades operatively connected to the ferrule, each of the first and second pivoting blades having a non-deployed position and a deployed position, each of the first and second pivoting blades being independently pivotable in relation to the ferrule and each other;

a non-pivoting blade operatively connected to the ferrule, the non-pivoting blade including a lower blade section and an upper neck section;

a tip including a point configured to penetrate and animal, the tip including an inner cavity and a lower section detachably connected to the upper section of the ferrule, wherein the upper neck section of the non-pivoting blade is partially accommodated within the inner cavity of the tip;

wherein in the non-deployed position, the first and second pivoting blades have a cutting diameter less than a cutting diameter of the non-pivoting blade and wherein in the deployed position, the first and second pivoting blades have a cutting diameter equal to or greater than the cutting diameter of the non-pivoting blade.

19. The broadhead of claim 18, further comprising a biasing means, the biasing means providing a biasing force upon the non-pivoting blade to reciprocate the non-pivoting blade against the first and second pivoting blades in a first position to thereby lock the first and second pivoting blades in the non-deployed position.

20. The broadhead of claim 19, wherein each of the first and second pivoting blades includes a locking shoulder for locking the first and second pivoting blades in the deployed position, wherein in the deployed position, the non-pivoting blade is reciprocated by the biasing force against the first and second pivoting blades in a second position, and wherein in the second position, the non-pivoting blade is in operative association with the locking shoulder to thereby prevent the first and second pivoting blades from retracting to the non-deployed position.

21. The broadhead of claim 20, wherein each of the first and second pivoting blades includes another locking shoulder, and wherein when the non-pivoting blade is in the first position, the non-pivoting blade is in operative association with the another locking shoulder to thereby maintaining the first and second pivoting blades in the non-deployed position.

22. The broadhead of claim 18, wherein the cutting diameter of the non-pivoting blade is about 1 inch.

23. The broadhead of claim 22, wherein in the deployed position, the cutting diameter of the first and second pivoting blades is about 2 inches.

24. A method of using a broadhead comprising the steps of:

a) providing a broadhead comprising: a ferrule having an upper section, a lower section, and a blade section interconnecting the upper and lower sections, the ferrule including a split extending longitudinally through the upper section and into the blade section defining a first side section and a second side section of the blade section, each of the first and second side sections of the blade section including a longitudinally extending aperture, the lower section configured for detachable connection to an arrow or bolt shaft; a first pivoting blade including a blade arm, a deployment arm, and a transition area interconnecting the blade arm and the deployment arm, the transition area including a pin recess therethrough, the deployment arm including a front edge having a first locking shoulder spaced apart from a second locking shoulder, the blade arm including an outside edge configured for cutting; a second pivoting blade including a blade arm, a deployment arm, and a transition area interconnecting the blade arm and the deployment arm, the transition area including a pin recess therethrough, the deployment arm including a front edge having a first locking shoulder spaced apart from a second locking shoulder, the blade arm including an outside edge configured for cutting; a pivot pin; a reciprocating blade including a lower blade section and an upper neck section, the lower blade section including a first arm section and a second arm section, the first arm section including an outer edge having a cutting surface, an inner edge, and a bottom edge interconnecting the outer and inner edges, the second arm section including an outer cutting edge, an inner edge, and a bottom edge interconnecting the outer and inner edges, the inner edges of the first and second arm sections interconnected by a transverse edge, the inner edges of the first and second arm sections and the transverse edge defining a slot; a spring including an upper section, a lower section, and an inner cavity; a tip including an upper end, a lower end, and an inner cavity defined by an inner surface, the lower end configured for detachable connection to the upper section of the ferrule; wherein the first and second pivoting blades are pivotally connected to the ferrule and each other in stacked arrangement by alignment of the pin recesses of the first and second pivoting blades within the split of the ferrule and placement of the pivot pin within the aligned pin recesses to form a pivot axis within the split of the ferrule; wherein the deployment arm of the first pivoting blade extends from the pivot axis out through the aperture of the second side section of the blade section and the blade arm of the first pivoting blade extends from the pivot axis out through the aperture in the first side section of the blade section; wherein the deployment arm of the second pivoting blade extends from the pivot axis out through the aperture of the first side section of the blade section and the blade arm of the second pivoting blade extends from the pivot axis out through the aperture in the second side section of the blade section; wherein the lower section of the reciprocating blade is positioned within the split of the ferrule with the inner edges of the first and second arm sections placed over the pivot pin to contain the pivot pin within the aligned recesses of the first and second pivoting blades and the transverse edge of the reciprocating blade being in operative association with the front edges of the deployment arms of the first and second pivoting blades; wherein the spring is positioned within the inner cavity of the tip, the upper section of the spring supported by the inner surface of the tip, the lower section of the spring supported by the neck section of the reciprocating blade; wherein the tip is detachably connected to the upper section of the ferrule; and wherein selective placement of the transverse edge of the reciprocating blade adjacent the first locking shoulders of the first and second pivoting blades defines a non-deployed position of the first and second pivoting blades and selective placement of the transverse edge of the reciprocating blade adjacent the second locking shoulders of the first and second pivoting blades defines a deployed position of the first and second pivoting blades;

b) affixing the broadhead to an arrow or bolt, the first and second pivoting blades being in the non-deployed position;

c) firing the arrow or bolt from an archery bow or crossbow at a target, whereby the first and second pivoting blades are locked in the non-deployed position during a flight of the arrow or bolt;

d) causing the broadhead to impact the target, whereby the first and second pivoting blades are placed in the deployed position upon the impact of the broadhead with the target and are locked in the deployed position.

25. The method of claim 24, wherein in step (c), the first and second pivoting blades are locked in the non-deployed position by a biasing force placed upon the front edges of the deployment arms by the transverse edge of the reciprocating blade positioned adjacent to the first locking shoulders.

26. The method of claim 25, wherein the biasing force is transferred to the transverse edge of the reciprocating blade by the spring.

27. The method of claim 26, wherein in step (d), the first and second pivoting blades transition from the locked non-deployed position to the locked deployed position by the impact of the broadhead with the target which causes an impact force to be applied to the deployment arms sufficient to overcome the biasing force resulting in first and second pivoting blades outwardly pivoting from the ferrule such that the transverse edge is repositioned from a first position adjacent to the first locking shoulder to a second position adjacent to the second locking shoulder of the front edges of the deployment arms, whereby the second locking shoulder prevents the first and second pivoting blades from retracting to the non-deployed position.

28. The method of claim 27, further comprising the step of:

(e) causing the first and second pivoting blades to return from the locked deployed position to the locked non-deployed position by a user pressing upward on one or more of the bottom edges of the first and second arm sections of the lower section of the reciprocating blade to release the transverse edge from applying biasing force to the front edges of the deployment arms.

* * * * *